US005252332A

United States Patent [19]

Goldstein

[11] Patent Number: 5,252,332

[45] Date of Patent: Oct. 12, 1993

[54] PRE-MOISTENED FLUSHABLE TOWLETTE IMPREGNATED WITH POLYVINYL ALCOHOL CONTAINING BINDERS

[75] Inventor: Joel E. Goldstein, Allentown, Pa.

[73] Assignee: Air Products and Chemicals, Inc., Allentown, Pa.

[21] Appl. No.: 919,513

[22] Filed: Jul. 24, 1992

[51] Int. Cl.[5] ..... A01N 25/34

[52] U.S. Cl. ..... 424/402; 428/74; 428/249; 428/490

[58] Field of Search ..... 424/402; 428/490, 249, 428/74

[56] References Cited

U.S. PATENT DOCUMENTS 3,689,314 9/1972 Duchane .
3,692,725 9/1972 Duchane ..... 260/29.6
3,808,165 4/1974 Duchane ..... 260/29.6
4,245,744 1/1981 Daniels et al. .
4,258,849 3/1981 Miller .
4,309,469 1/1982 Varona .
4,343,133 8/1982 Daniels et al. .
4,343,134 8/1982 Davidowich et al. .
4,343,403 8/1982 Daniels et al. .
4,372,447 2/1983 Miller .

*Primary Examiner*—Thurman K. Page
*Assistant Examiner*—D. Gabrielle Phelan
*Attorney, Agent, or Firm*—Michael Leach; James C. Simmons; William F. Marsh

[57] ABSTRACT

A packaged towelette comprising a sheet of nonwoven fibers impregnated with a polyvinyl alcohol containing binder and in contact with an aqueous solution containing borate ions and bicarbonate ions.

12 Claims, No Drawings

PRE-MOISTENED FLUSHABLE TOWLETTE IMPREGNATED WITH POLYVINYL ALCOHOL CONTAINING BINDERS

FIELD OF THE INVENTION

This invention relates to a pre-moistened nonwoven towelette that is readily disposable and water dispersible.

BACKGROUND OF THE INVENTION

The issue of disposability of products is of great concern to the nonwovens industry. Landfills, incineration, multiple sewage treatment and residential septic systems are among the common choices for nonwoven product disposal today. Products targeted for the latter disposal routes, via residential and commercial toilets, are termed flushable. Current flushable products have limitations. Dry products, such as bathroom tissue, have been designed with minimal wet strength so that the tissue can disintegrate under the agitation in the plumbing systems. They are not designed for applications where water will be encountered in use. Flushable wet wipes have high wet strengths and do not lose their strength upon disposal. These products remain intact and identifiable in the disposal system.

Wet-packaged skin cleansing and refreshing tissues are well known commercially, generally referred to as towelettes, wet wipes, fem wipes and the like. These may comprise an absorbent sheet made of paper, prepared or treated to impart wet strength thereto, having the dimensions of the usual wash cloth and packaged wet in folded condition, individually in impervious envelopes or in multiples in closed containers. The liquid employed in the pre-moistening of the sheet is generally an aqueous alcoholic solution which may further contain a surface active detergent and a humectant and, in some instances, also a scenting agent. Instead of individual packaging of such moist sheets, they are often marketed in reclosable containers having any desired convenient number of such folded sheets.

U.S. Pat. No. 3,689,314 discloses a method for making a flushable wrapper by treating a nonwoven web with an aqueous solution containing polyvinyl alcohol, boric acid and sodium bicarbonate, heating the web to a temperature sufficient to cause the boric acid and sodium bicarbonate to react and form borax, and to continue to heat the web to dry it so that substantially all of the borax crosslinks with the polyvinyl alcohol. The boric acid and sodium bicarbonate are used in such amounts as to generate at least 2 wt% borax based on the polyvinyl alcohol.

U.S. Pat. Nos. 4,258,849 and 4,245,744 disclose pre-moistened towelettes which are flushable. These towelettes incorporate a polyvinyl alcohol (PVOH) or PVOH stabilized polymer emulsion as a binder, respectively, and an aqueous pre-moistening lotion which contains salts (especially boric acid) that insolubilize the PVOH to impart good strength and integrity. Relatively high salt concentrations are required to impart good strength. For example, useful performance is not achieved until at least 3% boric acid is used. While other useful insolubilizing salts for PVOH need to be used at much higher concentrations to achieve the same effect, wipes prepared with these types of binders rapidly disintegrate in water by reduction in salt concentration and solubilization of the PVOH based binder.

U.S. Pat. No. 4,309,469 discloses a three component adhesive for nonwoven webs in combination with a water based lotion containing borate ions. The components of the adhesive composition applied to the web are PVOH, a non-self-crosslinking, thermosetting, polymer emulsion and a self-crosslinking, thermosetting polymer emulsion. An organic acid capable of complexing with borate, such as α-hydroxy acids or o-aromatic hydroxy acids, is claimed to produce a synergistic effect upon the PVOH adhesive in the web.

Due to some ingestion toxicity concerns, pre-moistened towelette manufacturers would require the reduction of the aqueous boric acid or borax (sodium tetraborate) solution from the 3-5% concentration level to 1% or less while still achieving a useful tensile strength of at least about 1.3 pli (~230 glc) in order to have a commercially viable product.

SUMMARY OF THE INVENTION

The present invention provides pre-moistened towelettes, or cloths, made of nonwoven fibers coated or impregnated with a PVOH containing binder to impart wet strength. The PVOH containing binder composition may be a PVOH, an aqueous PVOH stabilized polymer emulsion, a blend of a PVOH and an aqueous polymer emulsion, or any combination thereof. The towelettes are packaged in contact with an aqueous solution containing borate ions and bicarbonate ions, i.e., wet packaged.

The combination of borate ions and bicarbonate ions provides a much improved coagulant, or insolubilizer, for the PVOH containing flushable binder than either one alone. For example, wet tensile strengths comparable to an aqueous 3.3% boric acid solution can be achieved with less than 0.4% boric acid if the solution also contains about 0.5% bicarbonate.

The pre-moistened towelette of useful dimensions comprising nonwoven fibers, binder and the aqueous pre-moistening solution exhibits good wet tensile strength while stored in a sealed package and during use, and yet the towelette rapidly disintegrates in water.

DETAILED DESCRIPTION OF THE INVENTION

The initial treatment to coat or impregnate the nonwoven fabric, such as absorbent paper, with the PVOH containing binder may be carried out (1) by immersing the webs or running lengths of the fabric in an aqueous solution of the PVOH or in an aqueous polymer emulsion either stabilized with PVOH as the protective colloid or containing post-added PVOH or (2) by applying such solution or emulsion to the surfaces of the nonwoven web of fibers by spraying, by patting, by roller or other types of applicator. Following drying, the treated nonwoven web may be then cut to desired size sheets for the intended use. Of course, individual sheets precut to desired size may be treated with the aqueous PVOH solution or polymer emulsion and then dried.

The fibers may be any of the natural and synthetic fibers. Wood pulp (alone or blended with natural or synthetic fibers) processed by dry (air laid, carded, rando) or wet laid processes can be used. Nonwoven webs produced by air laid processes are preferred due to minimal hydrogen bonding of fibers in the finished product compared to wet laid nonwovens. Air laid processes impart little or no inherent integrity to the web which much be overcome with agitation to achieve complete disintegration of the web.

The nonwoven binders suitable for use in the invention include 75–90 mole% hydrolyzed, preferably 86–89 mole% hydrolyzed, PVOHs alone or blended with polymer emulsions. It is preferred to use PVOHs having a high molecular weight (DPn greater than 600 and ranging up to 2500 and more). Any polymer emulsion known in the art as a binder for nonwovens can be used when blended with a PVOH. It is also preferred that the emulsion polymer be non-crosslinking, e.g. does not contain polymerized N-methylolacrylamide, and most desirably contains PVOH as the protective colloid, or stabilizing system, in its preparation by aqueous emulsion polymerization. PVOH stabilized vinyl acetate (VAc) or vinyl acetate/ethylene (VAE) polymer emulsions are preferred due to their ease of water dispersibility. The ratio of PVOH to emulsion solids will depend upon the type of product being made and the choice of the polymer emulsion. The preferred range is a minimum 20 parts PVOH (dry) to 100 parts emulsion (dry) up to and including 100% PVOH, i.e., no emulsion polymer binder. The VAEs tend to be more hydrophobic and better film formers than the VAc polymers and require, accordingly, higher amounts of PVOH, i.e., up to 200 parts of PVOH per 100 parts emulsion (dry) compared to VAc polymers which may require up to 100 parts PVOH per 100 parts emulsions (dry).

The amount of polymer binder, calculated on the dry basis, applied to the fibrous starting web, is that amount which is at least sufficient to bind the fibers together to form a self-sustaining web and suitably ranges from about 3 to about 100% or more by weight of the starting web. Where PVOH is the polymer binder, about 3 to 20 wt% preferably is applied to the web. Where an aqueous polymer emulsion containing PVOH is the binder, about 5 to 50 wt% preferably is applied, the emulsion containing 20 to 200 parts PVOH per 100 parts emulsion on a dry basis.

The impregnated web is then dried by passing it through an air oven or the like for sufficient times and temperatures, such as drying at 1500°–200° F. (66°–93° C.) for 4 to 6 minutes (in lab tests designed to simulate production conditions).

The pre-moistened towelettes are packaged in contact with an aqueous solution containing borate ions and bicarbonate ions to temporarily insolubilize the PVOH containing binder. The borate ions may be provided by the use of boric acid (or a salt thereof) or borax (sodium tetraborate) since in water borax hydrolyzes to boric acid. The bicarbonate ions may be provided by a metal or ammonium bicarbonate or carbonate. Metal cations would include the alkali (Li, Na, K etc.) and alkaline (Be, Mg, Ca, etc.) cations. The preferred components of the aqueous pre-moistening solution are boric acid and sodium bicarbonate.

The aqueous solution should comprise about 0.2 to 2 wt% borate ions, preferably 0.3 to 1 wt%, and 0.2 to 3 wt% bicarbonate ions, preferably 0.4 to 2 wt%. The weight ratio of borate to bicarbonate ions can range from 4:1 to 1:4, preferably 2:1 to 1:2.

The aqueous solution may also contain other components typically included in manufacturing pre-moistened towelettes such as alcohol, preservatives, cleansing agents, fragrances, moisturizers and softeners.

The amount of the pre-moistening aqueous solution applied to the nonwoven may range from 150 to 400 wt% of the web.

Preferred pre-moistened towelettes are those that exhibit ≧1.3 pli (≧230 glc) and contain less than about 1 wt% boric acid (borate ions).

The finished towelette or wipes of desired dimensions may be individually packaged, preferably in folded condition, in moisture-proof envelopes or in containers holding any desired number of such folded sheets. For individual packaging, it will be convenient to wet the PVOH binder containing sheet with the aqueous solution containing borate and bicarbonate ions prior to inserting the sheet into the envelope or the composition may be injected into the open envelope which is subsequently sealed. If a number of the wet sheets are to be packaged in a single container which can be closed and reopened for removal of individual towelettes or wipes as needed, the folded sheets may either be pre-moistened with the aqueous solution or such solution may be poured over the stacked sheets in the container under conditions assuring appropriate wetting of each of the individual sheets.

Various forms of impermeable envelopes for containing wet package materials such as towelettes, wiping and polishing cloths and the like are well known in the art. Any of these may be employed to packaging the wetted towelettes of the present invention. The envelopes for the individual packaging may be formed of any material impervious to the liquid contents. Thus, the envelopes may be made of plastic materials or cellulosic materials lined or coated with plastic or other waterproof compositions. Preferably, the envelopes should be of a type that can be conveniently opened by tearing to remove the packaged wet towelette.

EXAMPLE 1

An air laid web of cellulose fibers (110 g/m$^2$ density) was sprayed with a 5% solids flushable binder to an add-on of 20 wt%. The binder composition comprised 80% Vinac® XX-210 polymer emulsion (PVOH stabilized polyvinyl acetate emulsion) and 20% Airvol® 523 PVOH (87–89 mole% hydrolyzed; DPn of ~1200). The dry tensile strength of the dried web was 16.9 pli (as measured in an Instron tester). The wet tensile strength (3 minute soak in 1% aqueous solution of dioctylsulfosuccinate sodium soda) was 0.0 pli. The dried web was tested for wet tensiles in a variety of aqueous solutions as shown in Table 1.

TABLE 1

| Aqueous Solution | Tensile pli | Tensile (glc) |
|---|---|---|
| 4.4% Boric Acid | 2.9 | 518 |
| 3.3% Boric Acid | 1.1 | 197 |
| 2.2% Boric Acid | 0.1 | 18 |
| 1.1% Boric Acid | 0.05 | 9 |
| 4.4% Sodium Sulfate | 0.36 | 64 |
| 4.4% Sodium Bicarbonate | 0.28 | 50 |
| 4.4% Aluminum Sulfate | 0.0 | 0 |
| 4.4% Borax | 3.1 | 554 |
| 1.5% Boric Acid/1.5% Sodium Bicarbonate | 3.4 | 608 |
| 3.0% Glycerin | 0.0 | 0 |
| 1.5% Boric Acid/3.0% Glycerin | 0.66 | 118 |
| 1.0% Boric Acid/1.0% Sodium Bicarbonate | 2.88 | 515 |
| 0.75% Boric Acid/0.75% Sodium Bicarbonate | 1.93 | 345 |
| 0.50% Boric Acid/0.5% Sodium Bicarbonate | 1.5 | 268 |
| 0.25% Boric Acid/0.25% Sodium Bicarbonate | 0.41 | 73 |
| 3.0% Boric Acid/1.5% Sodium Bicarbonate | 2.58 | 461 |
| 3.0% Boric Acid/4.5% Sodium Bicarbonate | 4.16 | 744 |
| 1.5% Boric Acid/3.0% Sodium Bicarbonate | 3.83 | 685 |
| 4.5% Boric Acid/3.0% Sodium Bicarbonate | 3.68 | 656 |
| 1.5% Boric Acid/1.5% Sodium Bisulfate | 0.16 | 29 |
| 4.4% Potassium Citrate | 0.33 | 59 |
| 7.5% Potassium Citrate | 0.40 | 72 |

TABLE 1-continued

| Aqueous Solution | Tensile pli | Tensile (glc) |
|---|---|---|
| 10.0% Potassium Citrate | 0.46 | 82 |
| 1.8% Boric Acid/1.2% Sodium Bicarbonate | 3.1 | 554 |
| 2% Boric Acid/1.0% Sodium Bicarbonate | 2.1 | 375 |
| 1% Boric Acid/2.0% Sodium Bicarbonate | 3.2 | 572 |
| 0.6% Boric Acid/0.9% Sodium Bicarbonate | 2.1 | 375 |
| 0.4% Boric Acid/0.6% Sodium Bicarbonate | 1.6 | 286 |
| 0.3% Boric Acid/0.45% Sodium Bicarbonate | 0.81 | 145 |

It can be readily seen from the data in Table 1 that the combination of boric acid and sodium bicarbonate provided for a synergistic effect on the wet tensile strength of the flushable web. For example, whereas the 3.3% boric acid solution and the 4.4% sodium bicarbonate solution gave wet tensiles of 1.1 and 0.28 pli (197 and 50 glc), respectively, a solution of 3.0% boric acid/4.50% sodium bicarbonate gave an impressive wet tensile of 4.16 pli (744 glc). Even at the low end concentration the solution of 0.25% boric acid/0.25% sodium bicarbonate gave a remarkable wet tensile of 0.41 pli (73 glc) compared to 0.05 pli (9 glc) for 1.1% boric acid and 0.28 pli (50 glc) for 4.4% sodium bicarbonate.

STATEMENT OF INDUSTRIAL APPLICATION

The present invention provides a pre-moistened towelette which comprises a PVOH containing binder in contact with an aqueous solution containing borate and bicarbonate ions. The towelette exhibits acceptable wet tensile strength but rapid disintegration in water.

I claim:

1. A packaged pre-moistened towelette comprising a web of nonwoven fibers bonded with a polyvinyl alcohol containing binder which is selected from the group consisting of a polyvinyl alcohol, an aqueous polyvinyl alcohol stabilized polymer emulsion, a blend of a polyvinyl alcohol and an aqueous polymer emulsion and a combination thereof, and in contact with an aqueous solution which consists essentially of 0.2 to 2 wt% borate ions and 0.2 to 3 wt% bicarbonate ions.

2. The towelette of claim 1 in which the weight ratio of borate ions to bicarbonate ions ranges from 4:1 to 1:4.

3. The towelette of claim 1 in which the weight ratio of borate ions to bicarbonate ions ranges from 2:1 to 1:2.

4. The towelette of claim 1 in which the amount of the aqueous solution ranges from 150 to 400 wt% of the web.

5. The towelette of claim 1 in which the borate ions are provided by boric acid or borax and the bicarbonate ions are provided by a metal or ammonium bicarbonate or carbonate.

6. The towelette of claim 1 in which the borate ions are provided by boric acid or borax and the bicarbonate ions are provided by sodium bicarbonate.

7. A packaged pre-moistened towelette comprising a web of nonwoven fibers bonded with a polyvinyl alcohol containing binder which is selected from the group consisting of a polyvinyl alcohol, an aqueous polyvinyl alcohol stabilized polymer emulsion, a blend of a polyvinyl alcohol and an aqueous polymer emulsion and a combination thereof, and in contact with an aqueous solution which consists essentially of 0.2 to 2 wt% boric acid and 0.2 to 3 wt% sodium bicarbonate in a weight ratio of boric acid to sodium bicarbonate ranging from 4:1 to 1:4, the amount of the aqueous solution ranging from 150 to 400 wt% of the web.

8. The towelette of claim 7 in which the weight ratio of boric acid to sodium bicarbonate ranges from 2:1 to 1:2.

9. The towelette of claim 8 in which the polyvinyl alcohol containing binder is a blend consisting essentially of a polyvinyl alcohol and a polyvinyl alcohol stabilized vinyl acetate or vinyl acetate/ethylene polymer emulsion.

10. The towelette of claim 9 in which the polyvinyl alcohol is 86–89 mole% hydrolyzed and has a degree of polymerization greater than 600 up to 2500.

11. The towelette of claim 10 in which the polyvinyl alcohol has a degree of polymerization of about 1200.

12. The towelette of claim 10 in which the aqueous solution consists essentially of 0.3 to 1 wt% borate ions and 0.4 to 2 wt% bicarbonate ions.

* * * * *